US005907983A

United States Patent [19]

Spirer

[11] Patent Number: 5,907,983

[45] Date of Patent: Jun. 1, 1999

[54] STUD REMOVER

[76] Inventor: Steven E. Spirer, 391 Haworth Ave., Haworth, N.J. 07641

[21] Appl. No.: 08/925,417

[22] Filed: Sep. 8, 1997

[51] Int. Cl.[6] ..... B25B 13/50

[52] U.S. Cl. ..... 81/53.2; 279/43

[58] Field of Search ..... 81/53.2; 279/43, 279/43.2, 43.4

[56] References Cited

U.S. PATENT DOCUMENTS

| | | | |
|---|---|---|---|
| 1,807,264 | 5/1931 | Walker . | |
| 1,815,500 | 7/1931 | Doan . | |
| 2,043,274 | 6/1936 | Wegner . | |
| 2,212,972 | 8/1940 | Armstrong . | |
| 2,367,480 | 1/1945 | Beswick . | |
| 2,391,624 | 12/1945 | Heuer . | |
| 2,681,582 | 6/1954 | Valvano . | |
| 2,719,445 | 10/1955 | Giebler . | |
| 3,104,569 | 9/1963 | Davis et al. . | |
| 3,457,812 | 7/1969 | Wagner, Jr. . | |
| 3,587,363 | 6/1971 | Rogers . | |
| 3,718,058 | 2/1973 | Jones, Jr. . | |
| 3,735,650 | 5/1973 | Weng, Jr. . | |
| 3,769,861 | 11/1973 | Kisle et al. . | |
| 5,253,556 | 10/1993 | Kelly et al. | 81/53.2 |
| 5,315,902 | 5/1994 | Ragland et al. . | |
| 5,349,887 | 9/1994 | Suwa | 81/53.2 |
| 5,372,055 | 12/1994 | Kelly et al. | 81/53.2 |
| 5,402,694 | 4/1995 | Kelly et al. | 81/53.2 |

*Primary Examiner*—David A. Scherbel
*Assistant Examiner*—Sinclair Skinner

[57] ABSTRACT

In a first embodiment, a hexagonal threaded nut includes a pair of horizontal slots about a peripheral portion extending through the nut into a central threaded bore. The slots form jaws which are tightened by pairs of vertical screws about a threaded stud engaged within the central bore. The sides of the slots are forced together to firmly grip the stud. Stress relieving bores at the ends of the slots aid in applying a high torque to the stud and facilitate removal. A standard wrench can be used to rotate the nut and unscrew the stud. Another embodiment utilizes a pair of like threaded nuts positioned on a threaded stud with a fixed spacing therebetween. Screws passing through holes in the two nuts are tightened to compress the spacing and affix the nut to the stud to permit removal. One method for removing studs includes threading a pair of like nuts onto a stud to provide a fixed spacing therebetween, the nuts having a plurality of threaded holes, threading a plurality of screws through respective holes in said nuts, and tightening the screws to compress the spacing and affix the nut to the stud to permit removal of the stud.

17 Claims, 7 Drawing Sheets

STUD REMOVER

BACKGROUND OF THE INVENTION

1. Field of the Invention

The present invention relates to devices for removing threaded rods or studs which are embedded in machinery, walls or other support structures, and particularly, to a tool for facilitating removal of such studs.

2. Description of the Related Art

Previous devices for removal of threaded rods or studs from various machinery to be repaired, such as engine blocks, have utilized conical members having vertical slots forming jaws which are compressed about the stud. An example of such a device is shown in U.S. Pat. No. 1,815,500 to Doan. An inner shank member has an upper threaded and a lower conical end with a longitudinal split forming jaws to fit around the stud. An outer body member having a hexagonal top and conical bottom fits over the threaded shank. A wrench tightens the outer member on the inner shank to close the jaws about the stud which can then be unscrewed and removed.

U.S. Pat. No. 1,807,264 to Walker discloses a tool for driving studs using a bead with a tapered hexagonal socket forming jaws, and a spring actuated plug fits into the jaws and grips a stud.

U.S. Pat. No. 2,043,274 to Wegner discloses a hexagonal body having a bore with cammed surfaces. A slotted sleeve with internal threads to fit over a stud and external cammed surfaces fits into the hexagonal body. A pin on the hex member and groove on the sleeve prevent undesired relative movement. A projecting flange and spring prevent longitudinal separation. The flange unites the cammed sleeve portions which coact with the hex surfaces when rotated to remove the stud.

U.S. Pat. No. 2,212,972 to Armstrong discloses a tool for inserting or removing corporation stops from gas or water mains. A threaded socket with extending fingers engages nipples on the stop member. Rotation of the socket causes rotation of the stop member without damaging the nipples.

U.S. Pat. No. 2,367,480 to Beswick discloses a quick attachment nut having hexagonal tapered external faces, a resilient frame with legs secured to the tapered faces and a hexagonal sleeve with internal tapered faces mounted over the frame and nut.

U.S. Pat. No. 2,391,624 to Heuer discloses a stud bolt retractor and drive using a slotted member having jaws and a tapered body with tapered threads. A groove has ribs for gripping a stud. A nut having internal threaded tapered surfaces engages the slotted member to rotate the stud.

U.S. Pat. No. 2,681,582 to Valvano discloses a stud driving and removing wrench. An outer body has a cavity with a pair of intersecting arcuate walls, a pair of threaded jaws engaging the walls, a pin and keepers holding the jaws in position to engage a stud.

U.S. Pat. No. 2,719,445 to Giebler discloses a stud puller having a sleeve with a tapered end and a tapered chuck within the sleeve having a bore to receive a stud. The chuck includes splits to form jaws and keyways and a pin to prevent undesired rotation. A screw is threaded into the sleeve to cause the chuck to engage and remove the stud.

U.S. Pat. No. 3,104,569 to Davis et al. discloses a stud bolt remover having a slotted tubular threaded tapered member that engages a stud. A nut engages the tubular member and a driving bolt forces the nut to clamp the tubular slotted member onto the stud to permit removal of the stud.

U.S. Pat. No. 3,457,812 to Wagner, Jr. discloses a housing with internal teeth at one end to engage and remove a fastener.

U.S. Pat. No. 3,587,363 to Rogers discloses a ball plunger holder with a threaded bore and a boss at one end. A screw is threaded into the holder and a ball plunger into the boss end. The ball plunger is tightened against the screw end and the assembly inserted into a work piece. For removal of the plunger, the ball is depressed by the screw to lock against the threads to permit removal.

U.S. Pat. No. 3,718,058 to Jones, Jr. discloses two threaded members with complementary camming surfaces to be threaded in alignment with a threaded stud. The members grip the stud to permit removal.

U.S. Pat. No. 3,735,650 to Weng, Jr. discloses an extractor tool having a collet with an annular array of pointed teeth that grip a stud when tightened.

U.S. Pat. No. 3,769,861 to Kisle et al. discloses a body threaded at one end for engaging a stud and at the other end for a take-up nut. A pair of jaws are positioned between the two ends and a tapered pin is between the jaws. Torque applied to the nut end causes force against the pin and jaws and lower threads to grip the stud.

Another device shown in U.S. Pat. No. 5,253,556 to Kelly et al. discloses a stud removal tool having three sleeves with different diameters and a tapered end. An inner slotted sleeve with a flared end is placed over the stud, with a second sleeve placed over the first sleeve and engaging the flared end. A third sleeve receives screws to force the second sleeve to collapse the end of the first sleeve against the stud. A wrench can then rotate the first sleeve to remove the stud.

U.S. Pat. No. 5,315,902 to Ragland et al. discloses a plurality of axial cams on the interior wall of a socket. The cams engage gripping jaws in a removable cartridge which grips a stud to be removed.

These devices are relatively complex, costly to manufacture and maintain, and have not performed effectively.

OBJECTS AND SUMMARY OF THE INVENTION

It is therefore the primary object of the present invention to provide an improved simplified device and method for removal of studs.

It is another object of the invention to provide a stud remover which can be readily attached and is efficient in releasing the stud.

It is a further object of the invention to provide a stud remover having a limited number of components and which can apply a high torque to grip the stud to facilitate removal.

A still further object is to provide a stud remover which causes minimum damage to the stud being removed.

Yet another object is to provide a stud remover having common components which are modified to apply the high torque required for gripping and removal of the stud.

Additional objects of the present invention are to provide an apparatus for removing a stud which:

is durable, is relatively economical to fabricate, does not require specialized tools to operate, is compact for use in tight spaces, is reliable, can be used with standard tools, uses the standard threads of the stud in removing the stud, engages the stud like a standard nut, can be manipulated and engaged with simple tools, is made from standard material, will not distort or bend the stud during removal of the stud, enables the stud to be reused after extraction, can be used as a guide to fix the stud to the removal tool to ensure removal, will not degrade the threaded bore that the stud is mounted in, does not require pulling on the stud, supports the stud that is to be removed to avoid damage to the stud, is simple to operate, can be operated by a single person with standard tools.

Other objects of the invention are to provide a method for removing studs which:

employs standard threaded apparatus, threads a remover onto the stud like a standard nut that engages the thread, allows for adjustment of the force affixing the stud to the stud removing tool, threads the stud removing tool onto the stud in the manner of a standard nut and then distorts the stud removing tool about the stud to fix the stud removing tool to the stud and then allow the stud removing tool to extract the stud by rotation of the stud removing tool, does not require distortion of the stud that is being removed, can be performed in confined spaces, does not require the use of large bulky tools, is relatively simple to perform, is relatively quick to perform, can be performed with standard tools, can rigidly fasten the stud removing tool to the stud without any alignment or positioning of the stud removal tool, employs standard sized nuts and wrenches for the stud involved, can be performed by one man without assistance of another, and will not damage the stud during the removal process.

These objects are achieved in one embodiment with a novel threaded hexagonal nut structure having a pair of horizontal narrow slots or slits about a major peripheral portion and extending through the nut into a central threaded bore. Solid areas between the ends of the slots provide a support structure. The slots form jaws which can be tightened about a threaded stud engaged within the central bore. Pairs of vertical screw holes and screws pass through opposite sides of the slots at two spaced locations and are tightened to force the sides of the slots together and apply pressure to grip the stud.

Stress relieving bores are included at the ends of the slots. The bores affect the force applied to the stud and may also facilitate removal of the stud. A standard wrench can then unscrew the nut and stud.

In another embodiment of the invention, the nut may have a vertical slot passing through a sidewall and into the central bore. A pair of horizontal screw holes and screws pass through the side of the nut and across the vertical slot and are tightened to apply force to the nut which grips the stud in the central bore to permit removal.

A further variation may include both a horizontal slot and vertical screws in one peripheral portion and a vertical slot with horizontal screws in an opposing sidewall.

An additional embodiment incorporates a pair of threaded nuts positioned on a threaded stud with a close spacing therebetween. A plurality of threaded holes and fastening means pass through the two nuts. The fastening means are tightened for the nuts to compress the space therebetween and affix the nuts to the threads of the stud so that rotation of the nuts rotates and removes the stud.

A method for removing studs includes threading a nut onto a like threaded stud, the nut having a peripheral slot and a central threaded bore with the slot passing through into the bore, positioning the nut on the stud and rotating the nut so that the stud engages the threads of the bore to extend through and beyond the slot and the nut is in position for coaction with a wrench, the nut having threaded holes passing through the nut body across the peripheral slot, engaging fastening means into said threaded holes, tightening the fastening means to distort the slot and threaded bore to affix the nut to the stud, applying a wrench to engage the nut, and rotating the nut and stud to remove the stud.

Another method includes threading a pair of nuts onto a threaded stud with a spacing therebetween, the nuts having threaded holes therethrough, inserting fastening means into said holes, and tightening the fastening means to compress the space between the nuts to affix the nuts to the threads of the stud, and applying a wrench to rotate said nuts and stud to remove said stud.

Other objects and advantages will become apparent from the following description taken in conjunction with the accompanying drawings.

DESCRIPTION OF THE PREFERRED EMBODIMENTS

Figure 1:
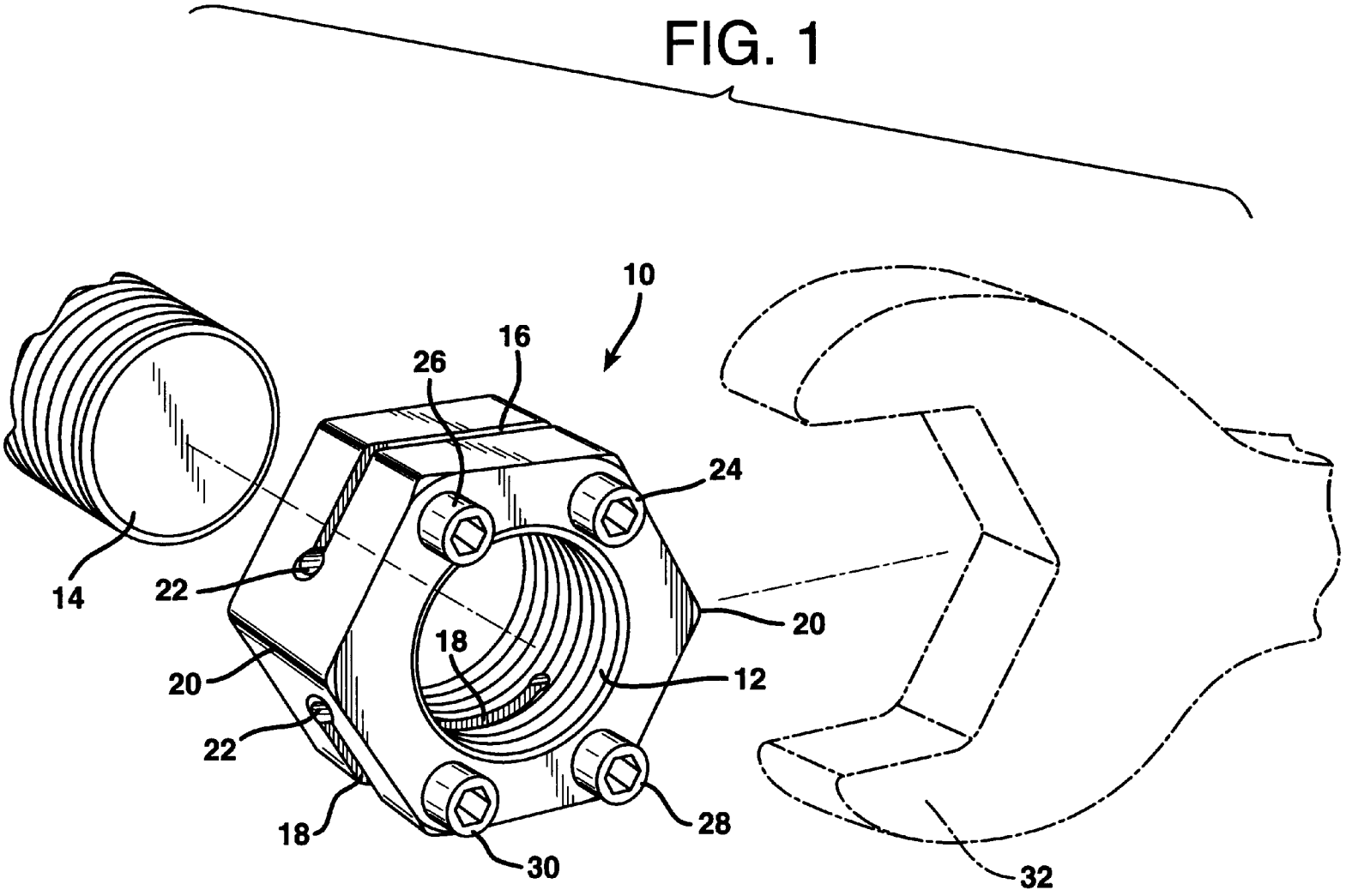
FIG. 1 is an exploded perspective view of a first embodiment showing horizontal slots through spaced peripheral portions of a hexagonal nut, two pairs of screws on the upper surface over respective slots, a portion of a stud to be engaged within a central bore in the nut and an end portion of a standard wrench for unscrewing the nut and stud.

As shown in FIG. 1, a multi-faceted, preferably hexagonal, nut 10 includes a central threaded bore 12 to receive an end of a threaded rod or stud 14 embedded in machinery such as an engine block to be repaired. The nut has two peripheral slots 16,18 extending horizontally through the nut to communicate with horizontal portions of the central bore. The slots extend around the sides of the nut and solid portions 20 at opposite ends separate the two slots. Stress relieving holes 22 at the slot ends affect the force necessary to be applied to the slots in gripping a stud received in the central bore. Two pairs of screws 24,26 and 28,30 are positioned over mid-sections of the slots and pass vertically through threaded holes in the upper and lower portions of the nut and through the open slots.

In use, the nut is first screwed onto a stud by hand with the stud extending through and beyond the slot in engagement with the threaded bore. Tightening of the screws then causes the slots to deform to provide jaws which engage the stud on opposite sides with sufficient force to maintain a tight secure grip. A wrench 32 is adapted to receive the nut which can then be counter rotated by the wrench and removed with the stud.

Figure 2:
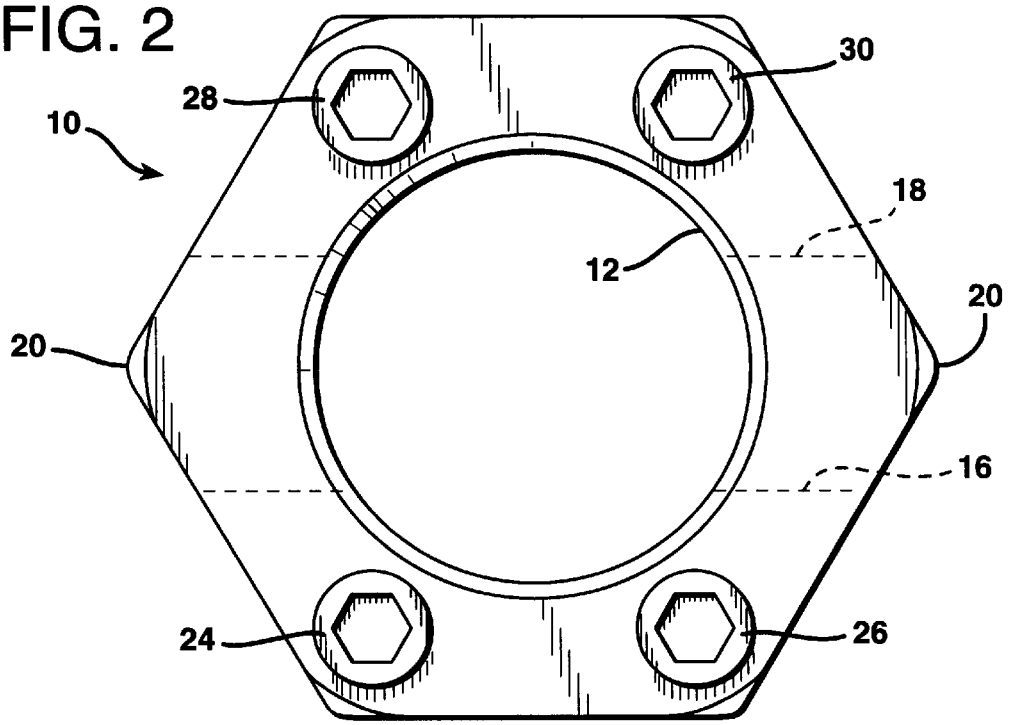
FIGS. 2 and 3 show top and bottom views of the hexagonal nut and screws of FIG. 1.
Figure 3:
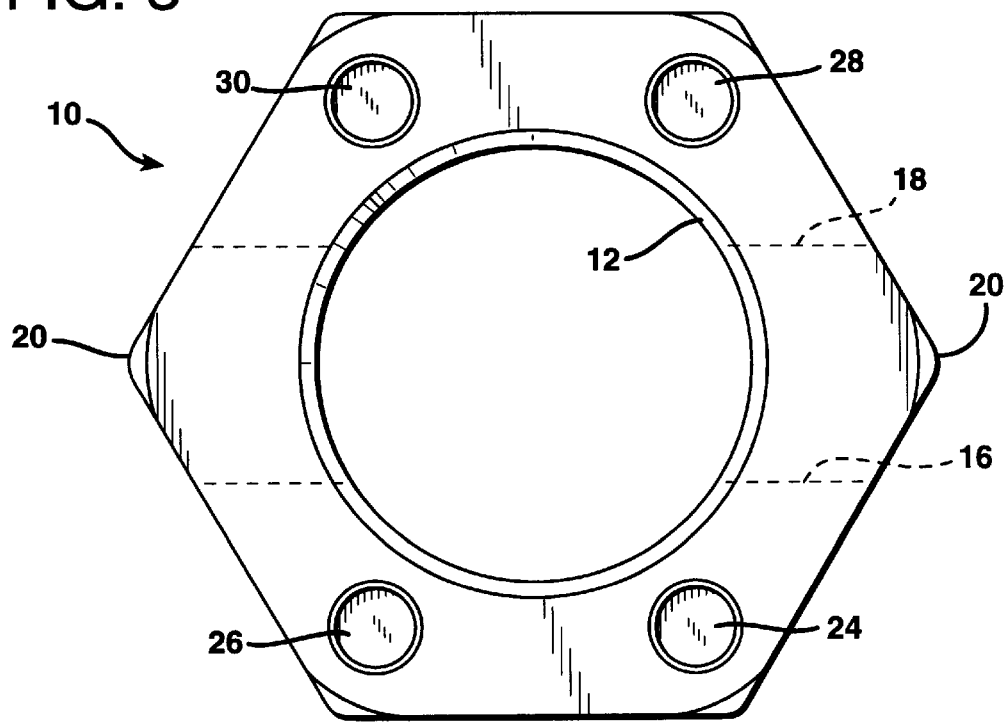

As illustrated in FIGS. 2 and 3, the top and bottom views, respectively, show the pairs of screws 24,26 and 28,30 engaging nut 10 on upper and lower faces positioned on opposite sides of central bore 12 in engagement with threaded holes. The dotted lines represent the limits of slots 16 and 18.

The holes may be threaded in only one vertical section to engage the screws. For example, the lower vertical section of the holes can be threaded and the upper section unthreaded to engage only the lower threaded portions of the screws. The same tightening action can deform the slots.

Figure 4:
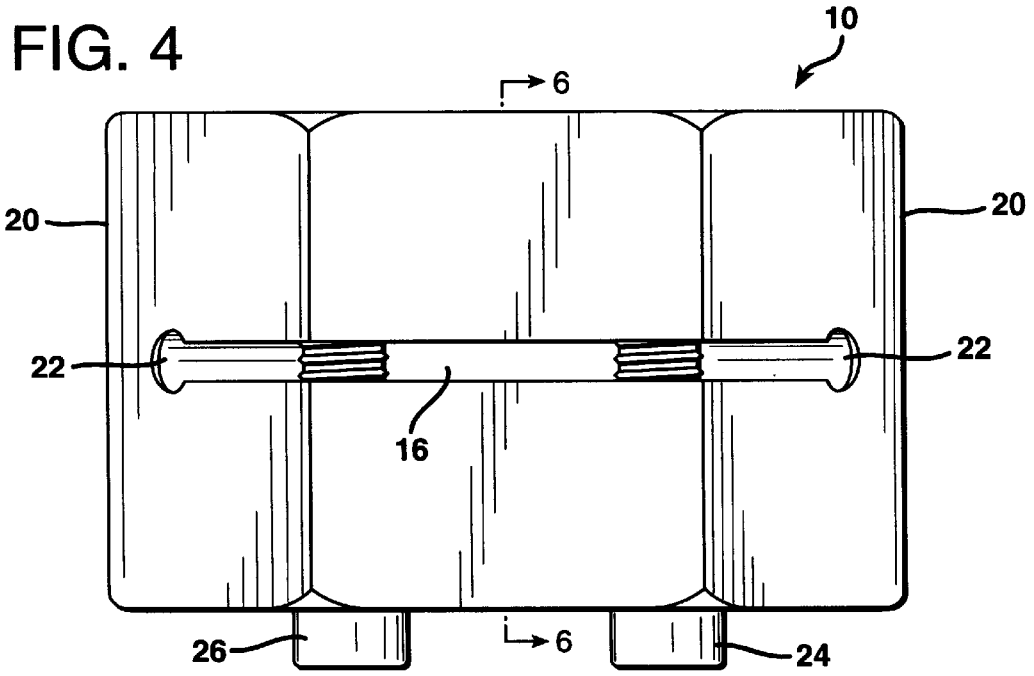
FIGS. 4 shows a side view of the nut of FIG. 1 facing one slot.

FIG. 4 shows a side view of hexagonal nut 10 illustrating the location of slot 16 across three faces of the nut with solid end positions 20 on opposite sides providing structural support. The slots include stress relieving holes 22 at the ends. The holes 22 aid in the application of force by the opposing sides of the jaws formed by the slots when the screws are tightened to deform and close the slots and engage the stud. The torque necessary to deform the slot is inversely proportional to the diameter of the stress relief holes. The larger the diameter of the hole, the smaller the force necessary to bend the jaws to cause the nut to grip the threads of the stud. The holes also provide access to receive a small pry bar or lever to assist in removing the stud.

Figure 5:
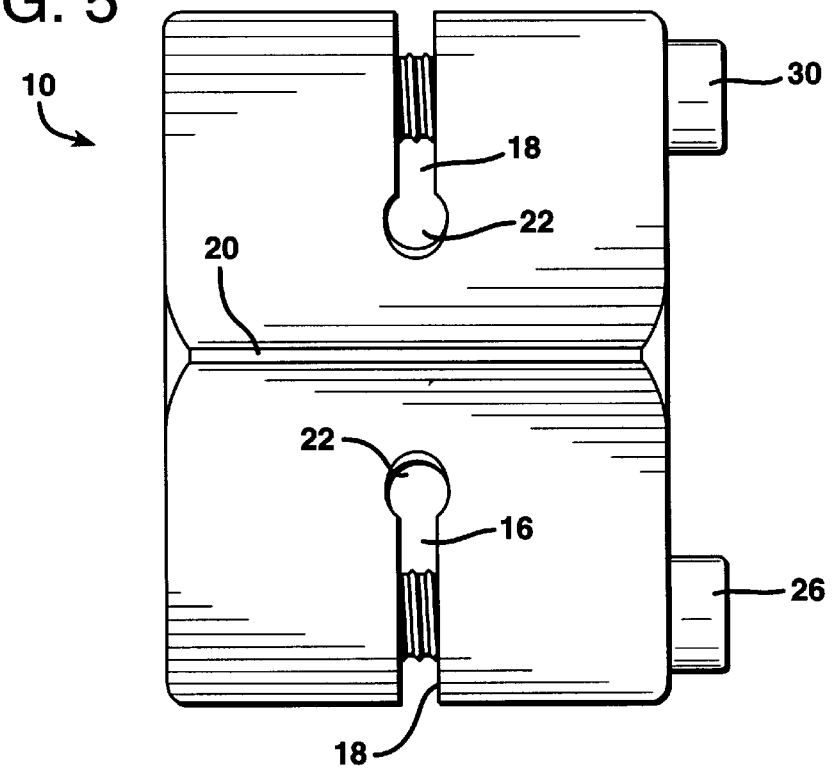
FIG. 5 shows another side view of FIG. 1 facing a solid portion between slots.

FIG. 5 is another side view of nut 10 showing the ends of slots 16 and 18 and solid area 20 therebetween.

Figure 6:
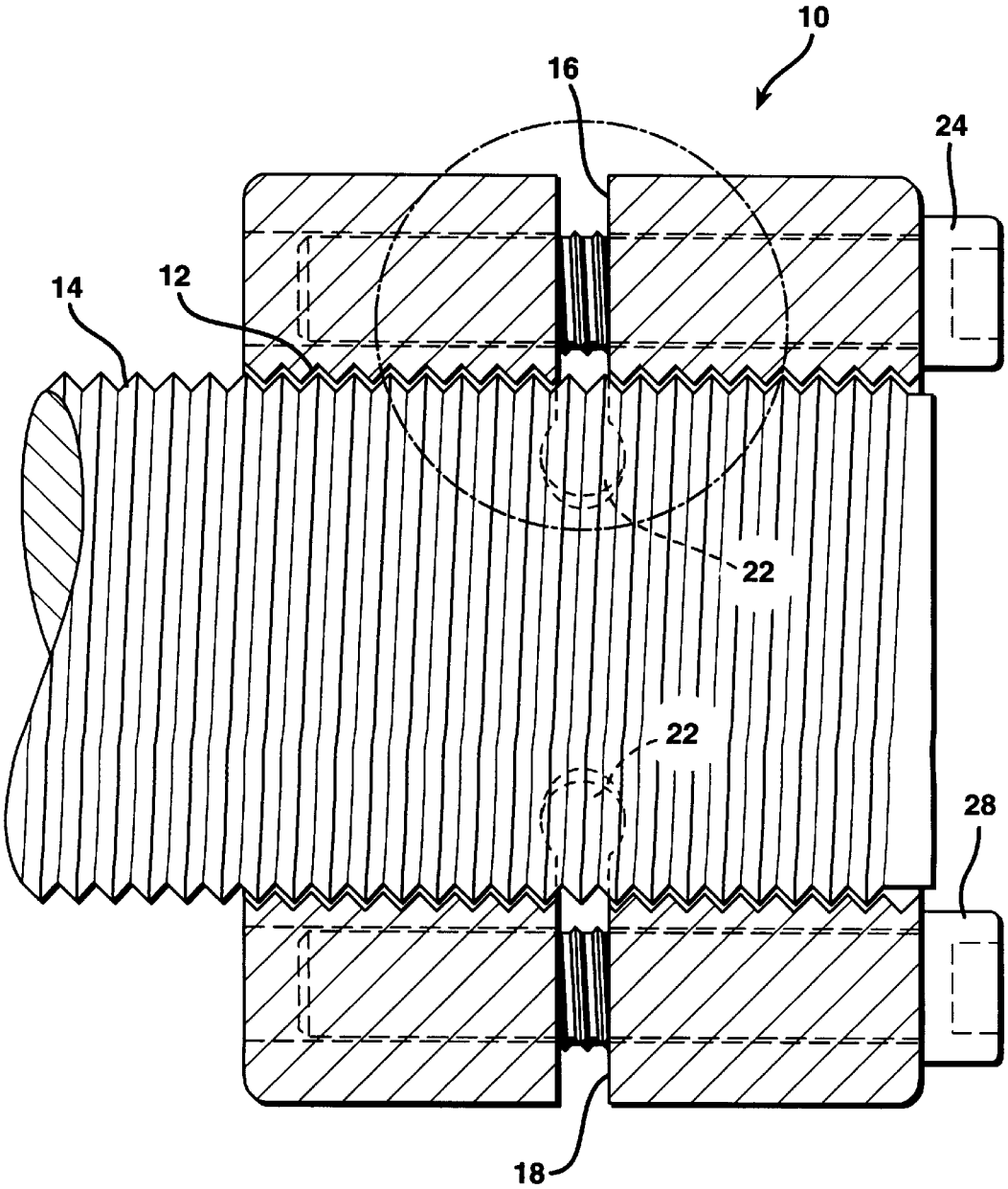
FIG. 6 is a cross-sectional view of the nut of FIGS. 1 and 4 taken along line 6—6 of FIG. 4 with the nut engaging the stud.

FIG. 6, which is a cross-section of the nut of FIG. 4 taken along line 6—6, shows the nut 10 engaging the threads of stud 14 with screws 24 and 28 passing through threaded holes in the nut and through respective slots 16,18 which communicate with bore 12.

Figure 7:
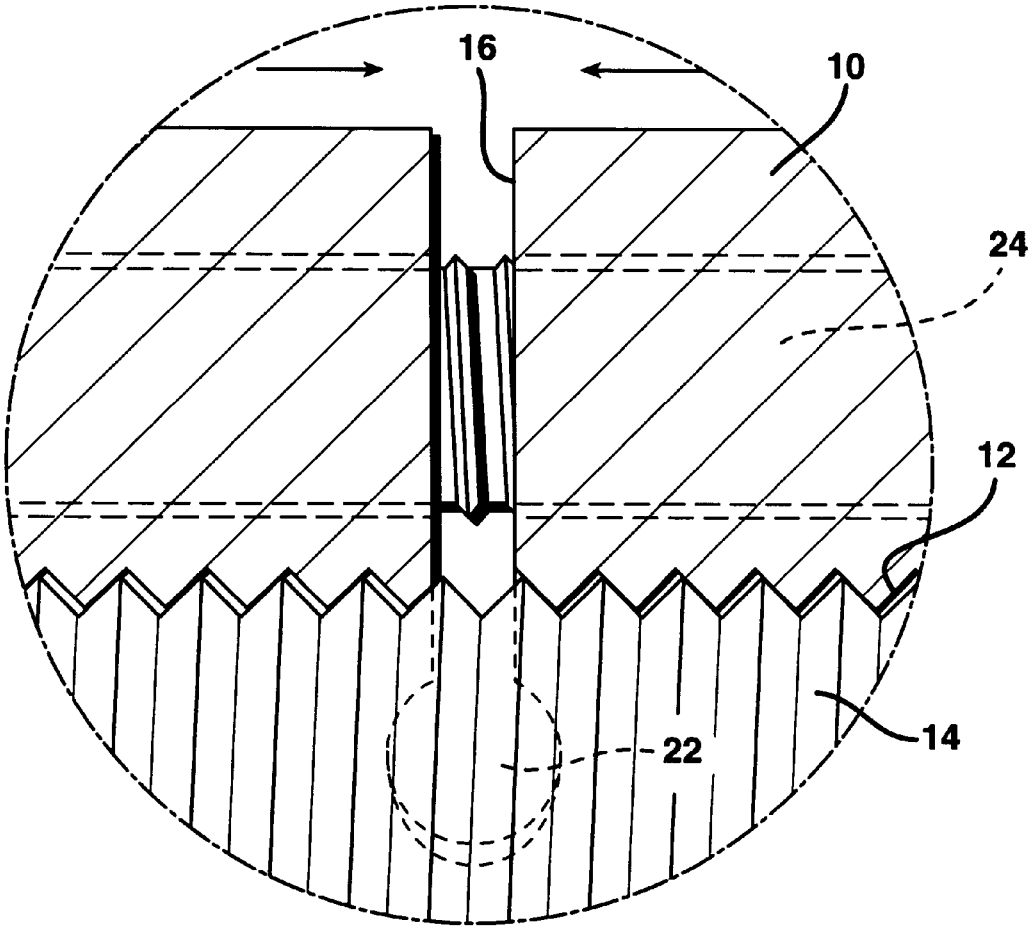
FIG. 7 is an enlarged detailed view of the encircled portion of FIG. 6 showing a screw passing through opposite sides of a slot to be tightened about a central stud.

FIG. 7 is an enlarged detailed view of the encircled portion of FIG. 6. As the screw 24 is tightened, the opposite sides of slot 16 forms jaws which deform and move together to apply force against and engage the threads of stud 14. This action provides a sufficiently powerful grip of the stud so that counter rotation of a wrench engaging the nut permits removal of the stud as the nut is unscrewed.

Figure 8:
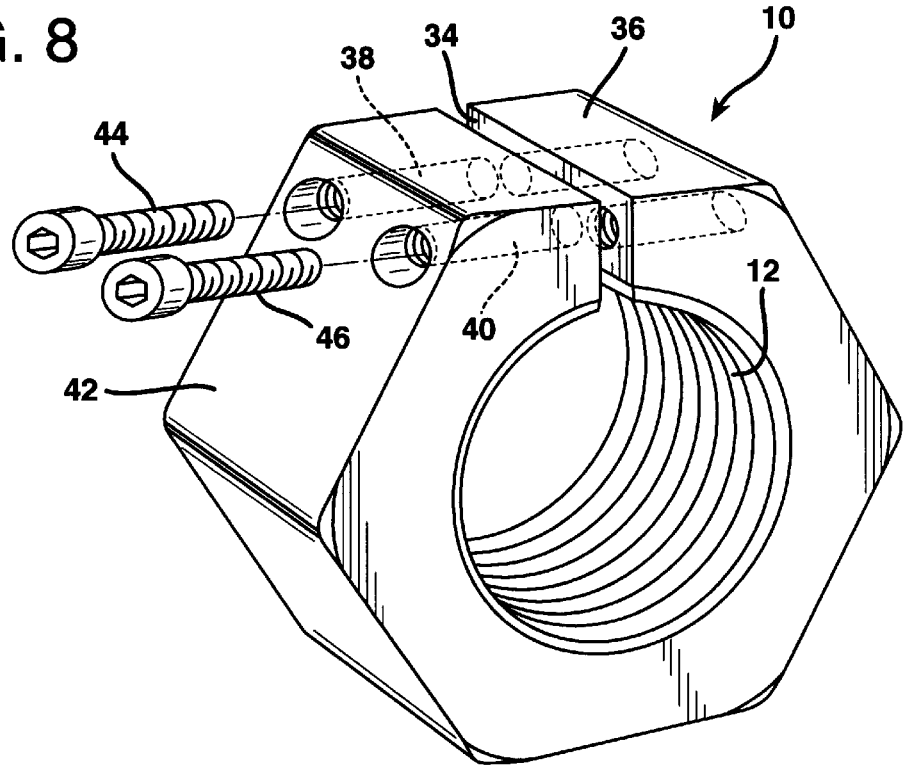
FIG. 8 is a perspective view of a second embodiment of a hexagonal nut showing a vertical slot and horizontal screws.

FIG. 8 illustrates another embodiment of a hexagonal nut having a vertical slot 34 through a side 36. The slot 34 passes through side 36 to communicate with a vertical portion of central bore 12 that is adapted to engage a threaded stud to be removed. Threaded holes 38,40 in adjacent side 42 pass horizontally through the solid portion of nut 10 parallel to side 36 and across slot 34 to the other solid portion of nut 10. The holes are recessed on side 42 to receive screws 44,46 so that the screw heads do not extend from the side. This permits a wrench to fit closely about and engage the hexagonal nut without interference from protruding screw heads. In use, a similar action to that of the type of FIG. 1 occurs. The nut 10 is first hand screwed onto the stud to be removed. The screws 44,46 are threaded into holes 38,40 across the slot 34 and tightened with a sufficient torque to deform slot 34 and forcefully grip the threads of the stud. Counter rotation of a wrench engaging the nut then causes corresponding rotation of the nut and stud to remove the stud.

Figure 9:
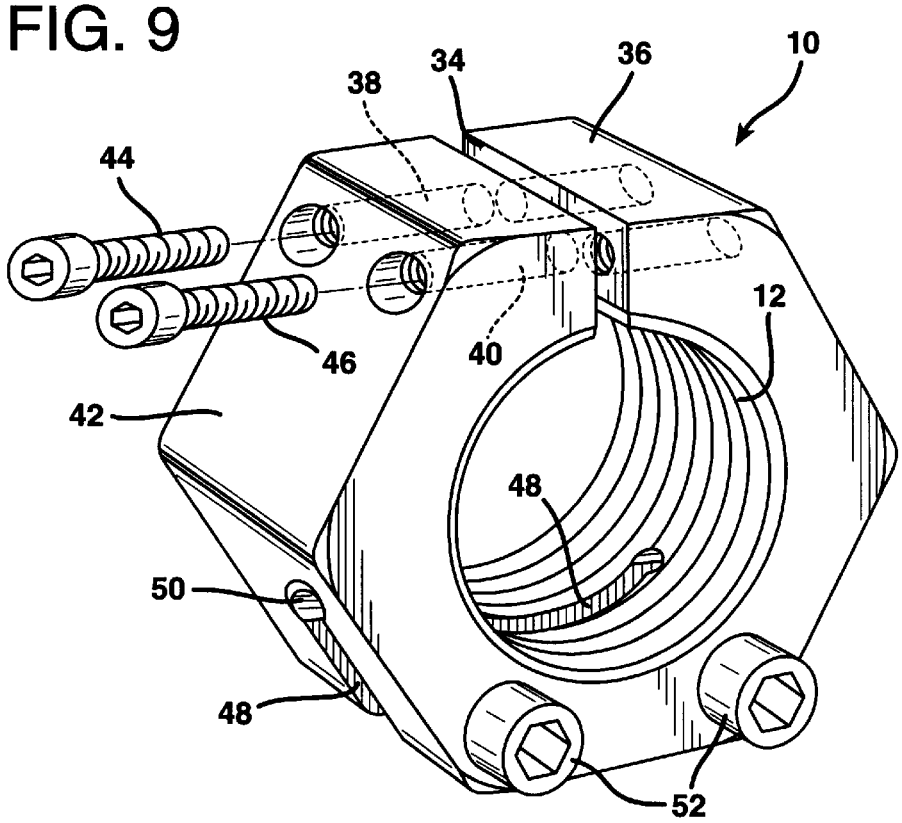
FIG. 9 is a perspective view showing another embodiment having both a horizontal slot with vertical tightening screws in one area and a vertical slot with horizontal tightening screws in a second area.

FIG. 9 illustrates a further embodiment incorporating the two variations of both FIGS. 1 and 8. In this case, a vertical slot 34 through side 36 communicates with central bore 12 and two screws 44,46 are received in horizontal holes 38,40 in side 42 and pass through slot 34 to engage the solid portions of the nut. The action in deforming the slot and gripping the stud threads is similar to that in the previous embodiment.

In addition, an opposite side of the nut includes a peripheral horizontal slot 48 communicating with central bore 12. The slot 48 includes like stress relief holes 50, with a pair of screws 52 passing through threaded holes and across slot 48 to engage the opposing portion of the nut. The action is again the same as that of FIG. 1 wherein tightening of screws 52 deforms slot 48 to cause the nut to grip the stud threads and permit removal.

Figure 10:
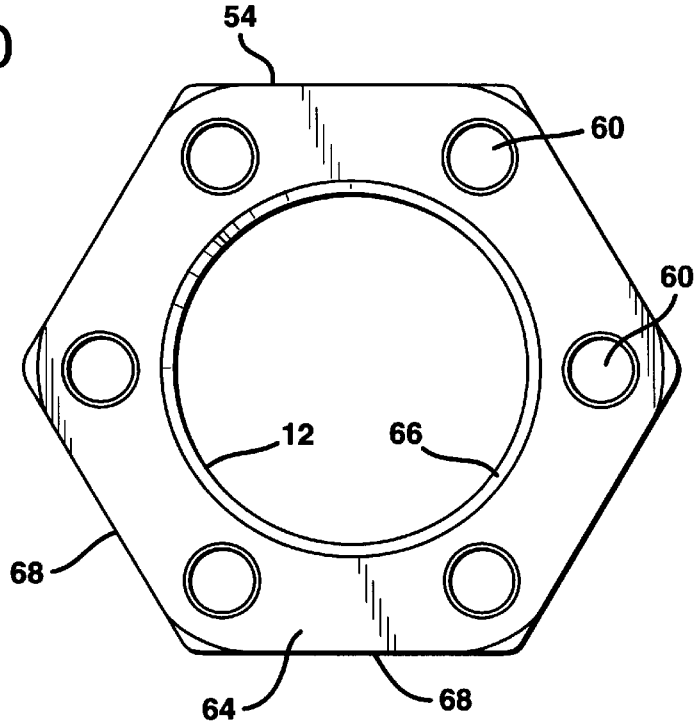
FIGS. 10 and 11 show top and side views of a further embodiment including a pair of nuts engaging a stud with a fixed spacing therebetween.
Figure 11:
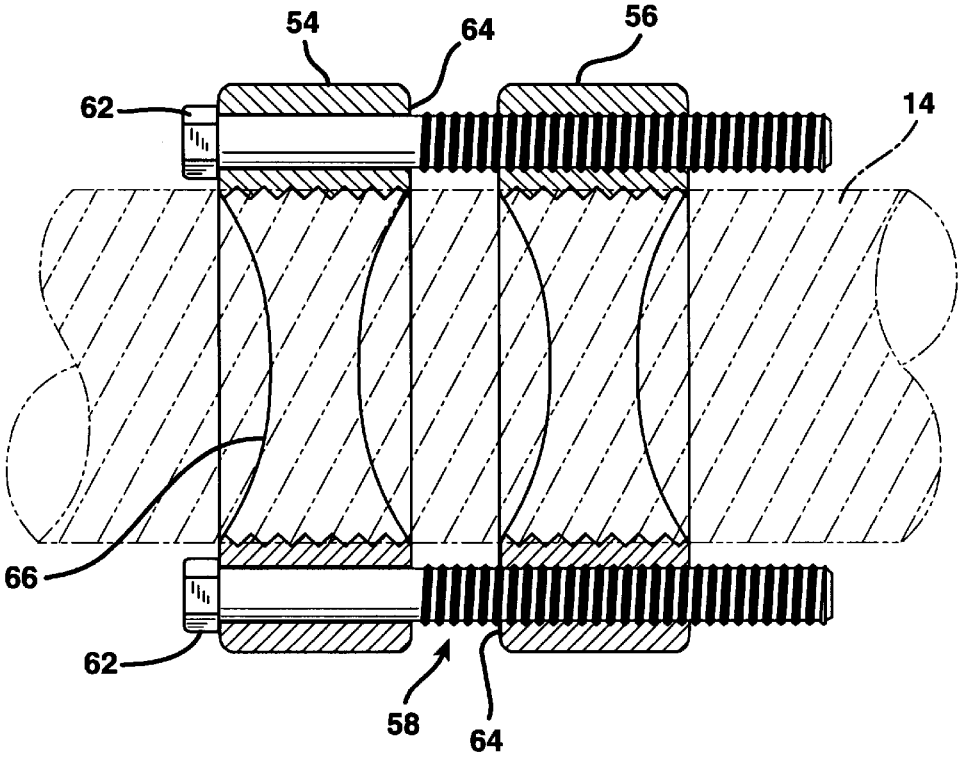

FIGS. 10 and 11 illustrate a further embodiment including a pair of like standard hexagonal nuts 54,56 having a central threaded bore 12 positioned on a threaded stud 14 to provide a desired close fixed spacing 58 therebetween. The spacing is preferably between 1/16 and 3/16 inches and this embodiment is most useful with studs of less than 4 inches in diameter. The nuts have six like threaded holes 60 passing through the pair and six screws 62 engage the respective holes. The holes in both nuts 54,56 may be threaded or only the outer nut holes may be threaded to engage only the lower threaded portions of the screws. The outer top and bottom surfaces 64 of each nut are flat in the peripheral areas of the holes, while the inner central areas 66 are rounded.

In operation, the nuts 54,56 are threaded onto the coacting threads of stud 14 to set a predetermined spacing therebetween. The gap is adjustable with rotation of the nut in 1/6 increments so that the flat facets 68 of the two nuts are in alignment along with the screw holes. The screws are then threaded into the holes and tightened with sufficient force to compress the space between the nuts and affix the nuts to the threads of the stud. A wrench is then applied to rotate the nuts and stud to remove the stud.

While only a certain number of embodiments have been illustrated and described, other variations may be practiced in the particular configuration without departing from the scope of the invention as set forth in the appended claims.

What is claimed is:

1. A stud remover comprising:

a hexagonal nut having a threaded central bore adapted to threadably engage a stud, said nut having flat top and bottom surfaces, and hexagonal side faces perpendicular to said flat top and bottom surfaces;

a pair of opposing peripheral horizontal slots each extending through three faces of said nut and having solid portions of said nut at opposite sides between the ends of said slots, said slots extending into said central bore, said slots forming upper and lower jaws having opposed faces in spaced parallel relationship;

a pair of enlarged bores at respective ends of each horizontal slot extending into said central bore and perpendicular to the axis thereof, each of said enlarged bores having a diameter greater than the distance between opposed faces of said upper and lower jaws;

a pair of threaded holes extending vertically across each of said horizontal slots forming upper and lower threaded holes spaced by said slot and having like internal threads; and pairs of threaded fastening members extending through respective holes from said upper threaded holes to said lower threaded holes to engage the lower threaded holes, said upper and lower jaws coacting upon tightening of said fastening members to cause distortion of said jaws and central bore threads to affix said nut to a stud engaged therein and permit removal of said stud.

2. A stud remover comprising:

a multi-faceted nut having a threaded central bore adapted to receive a threaded stud;

a peripheral slot having opposing faces extending through a side of said nut into said central bore;

a threaded hole in said nut positioned perpendicular to and extending across said slot; and fastening means received in said hole and adapted to be tightened to force said opposing faces together and cause said nut to grip and engage said stud to permit removal of said stud.

3. The device of claim 2 including a pair of peripheral slots extending horizontally through opposite sides of said nut, pairs of holes passing vertically through said nut across said slots, said holes being threaded in at least one portion thereof, and pairs of screws received in said holes for tightening said nut into engagement with said stud.

4. The device of claim 3 wherein said pair of peripheral slots are separated by solid portions of said nut at opposite sides between said slots.

5. The device of claim 4 including a wrench adapted to receive said nut and engaged stud for rotation and removal of said nut and stud.

6. The device of claim 4 wherein said slots include stress relieving holes at opposite ends.

7. The device of claim 2 wherein said slot extends vertically through a sidewall of said nut, a pair of holes pass horizontally through said nut across said slot, said holes being threaded in at least one portion thereof, and a pair of screws received in said holes for tightening said nut into engagement with said stud with sufficient force to permit removal of said nut and stud.

8. The device of claim 7 wherein said nut is hexagonal.

9. The device of claim 2 including a first peripheral slot extending horizontally through a side of said nut, a first pair of threaded holes passing vertically through said nut across said first slot, a first pair of screws received in said first pair of holes for tightening said nut into engagement with said stud, a second peripheral slot extending vertically through an opposite side wall of said nut, a second pair of threaded holes passing horizontally through said nut across said second slot, a second pair of screws received in said second holes for tightening said nut into engagement with said stud, and a wrench adapted to receive said nut and engaged stud for rotation and removal of said nut and stud.

10. The device of claim 9 wherein said nut is hexagonal.

11. A stud remover comprising:

a pair of like hexagonal nuts having central threaded bores adapted to engage a stud, said nuts having flat top and bottom surfaces, and hexagonal side faces perpendicular to said flat top and bottom surfaces, said nuts being positioned on said stud one above the other in a fixed spaced relationship therebetween;

a plurality of threaded holes extending vertically through said nuts and in alignment across the spacing therebetween; and a plurality of threaded fastening members extending through and engaging respective holes in said pair of nuts, said fastening members adapted to be tightened to compress the spacing between said nuts and affix said nuts to the stud so that rotation of said nuts will rotate and remove said stud.

12. Multi-faceted nut means having upper and lower internally threaded portions adapted to threadably engage a stud, said upper and lower portions being positioned on said stud and having a fixed spaced relationship therebetween, hole means passing through said upper and lower portions and being threaded in at least one of said upper and lower portions, and fastening means engageable with said hole means in said threaded portions, said fastening means adapted to be tightened to compress the space between said upper and lower portions and affix said portions to the stud so that rotation of said nut means will rotate and remove said stud.

13. A method for removing a stud embedded in machinery comprising;

threading a multi-faceted nut means having upper and lower internally threaded portions onto a threaded stud to engage said upper and lower portions, said upper and lower portions having threaded holes therethrough, positioning and rotating said nut means so that the stud engages said upper and lower portions with a fixed spaced relationship therebetween and said upper and lower holes and nut faces are in alignment, inserting fastening means into said holes, tightening said fastening means to compress the space between said upper and lower portions to affix said portions to said stud, positioning said nut means and stud for coaction with a wrench, and applying a wrench onto said nut means and engaged stud to rotate and remove said nut and stud.

14. The method of claim 13 wherein said peripheral slot extends horizontally through a side of said nut and includes stress holes at the ends of said slot, and including inserting a bar into said stress holes to apply leverage in facilitating removal of said nut and stud.

15. A method for removing a stud embedded in machinery comprising;

threading a multi-faceted nut means having upper and lower internally threaded portions onto a threaded stud to engage said upper and lower portions, at least one of said upper and lower portions having threaded holes therethrough, positioning and rotating said nut means so that the stud engages said upper and lower portions with a fixed spaced relationship therebetween and said upper and lower holes and nut faces are in alignment, inserting fastening means into said holes, tightening said fastening means to compress the space between said upper and lower portions to affix said portions to said stud, positioning said nut means and stud for coaction with a wrench, and applying a wrench onto said nut means and engaged stud to rotate and remove said nut and stud.

16. The method of claim 15 wherein said nut means includes a pair of like threaded nuts forming said upper and lower portions, and threading said pair of nuts onto said stud with a fixed spacing therebetween.

17. The method of claim 15 wherein said nut means includes a pair of like threaded nuts forming said upper and lower portions, threading one of said nuts onto said stud, threading the other of said nuts onto said stud, and bringing the nuts into registration so that the nut faces and holes are in alignment and said nuts have a fixed spaced relationship therebetween.

* * * * *